US010465576B2

(12) United States Patent
Reustle et al.

(10) Patent No.: US 10,465,576 B2
(45) Date of Patent: Nov. 5, 2019

(54) MAIN OIL GALLERY FOR THE CRANKCASE OF AN INTERNAL COMBUSTION ENGINE

(71) Applicant: Dr. Ing. h.c. F. Porsche Aktiengesellschaft, Stuttgart (DE)

(72) Inventors: Albrecht Reustle, Walheim (DE); Sven Robkov, Stuttgart (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 0 days.

(21) Appl. No.: 15/873,090

(22) Filed: Jan. 17, 2018

(65) Prior Publication Data

US 2018/0202332 A1 Jul. 19, 2018

(30) Foreign Application Priority Data

Jan. 17, 2017 (DE) ..... 10 2017 100 770

(51) Int. Cl.

| | |
|---|---|
| ***F01M 11/02*** | (2006.01) |
| ***F01M 1/16*** | (2006.01) |
| *F01M 1/02* | (2006.01) |
| *F01M 1/06* | (2006.01) |

(52) U.S. Cl.

CPC ..... *F01M 11/02* (2013.01); *F01M 1/16* (2013.01); *F01M 1/02* (2013.01); *F01M 2001/062* (2013.01); *F01M 2011/026* (2013.01)

(58) Field of Classification Search

CPC .... F01M 11/02; F01M 1/16; F01M 2011/026; F01M 2001/062; F01M 1/02

See application file for complete search history.

(56) References Cited

U.S. PATENT DOCUMENTS

2017/0074205 A1* 3/2017 Maki ..... F02F 1/20

* cited by examiner

*Primary Examiner* — Xiao En Mo

(74) *Attorney, Agent, or Firm* — Gerald E. Hespos; Michael J. Porco; Matthew T. Hespos

(57) ABSTRACT

A substantially tubular supply line (2, 11) of a main oil gallery (1, 10) for distributing lubricating or cooling oil to bearing points of a crankshaft of an internal combustion engine. The supply line (2, 11) has at least one inflow opening (3, 5, 6, 13) arranged on the supply line (2, 11) and feed lines (4, 12) having feed line openings (7.1, 7.2) on the supply line (2, 11) for feeding the lubricating or cooling oil to the bearing points of the crankshaft in the crankcase. The inflow opening (3, 5, 6, 7.1, 7.2, 13) is formed in a flow-favorable manner and may define a funnel shape.

11 Claims, 1 Drawing Sheet

MAIN OIL GALLERY FOR THE CRANKCASE OF AN INTERNAL COMBUSTION ENGINE

CROSS REFERENCE TO RELATED APPLICATION

This application claims priority under 35 USC 119 to German Patent Appl. No. 10 2017 100 770.9 filed on Jan. 17, 2017, the entire disclosure of which is incorporated herein by reference.

BACKGROUND

Field of the Invention

The invention relates to a main oil gallery having a substantially tubular supply line for distributing lubricating or cooling oil to bearing points of a crankshaft of an internal combustion engine, having at least one inflow opening and feed lines to the bearing points of the crankshaft in the crankcase.

Description of the Related Art

To accommodate and to mount the crankshaft of an internal combustion engine, at least two bearings are provided in the crankcase and, to supply the bearings with lubricating or cooling oil, a pump is provided to deliver the oil to the bearings. The oil distributed by the pump and via the rotating crankshaft in the crankcase is used to supply the substantially tubular supply line of a main oil gallery, via which the oil is passed directly via feed lines to the bearing points of the crankshaft in the crankcase.

The bearings or the bearing points of the crankshaft are subject to high loading and must be supplied with oil in as continuous a manner as possible. It is an object of the invention to ensure a continuous supply of lubricating or cooling oil lubricating or cooling oil and a uniform volumetric flow of oil to the bearing points.

SUMMARY

The invention relates to a tubular supply line of a main oil gallery, and particularly a tubular supply line formed with at least one inflow opening configured and disposed to achieve a favorable flow of the lubricating or cooling oil. The at least one inflow opening can be formed into the tube interior of the supply line in a flow-concentrating or flow-dissipating manner depending on the flow conditions for the lubricating or cooling oil in the crankcase or in the supply line.

The at least one inflow opening may be formed to be funnel-shaped with a narrowing oriented toward the center of the tubular supply line. The inflow opening can be arranged on the circumference of the supply line. In addition, the open ends of the substantially tubular supply line can be used as inflow openings. Dependent on the flow conditions in the crankcase, it is also conceivable for the inflow opening to be funnel-shaped with a widening of the funnel arranged toward the center of the tubular supply line.

The supply line of a main oil gallery may be produced from metallic material that is resistant to lubricating or cooling oil.

The tubular supply line may be composed, for example, of steel, a light metal, a light metal alloy or a plastic. The funnel shape of the inflow opening may be produced by machining. In the simplest embodiment, the funnel shape can be formed by a continuous countersinking of a bore by machining.

However, it is also conceivable for the funnel shape of the inflow opening to be produced in a noncutting forming process, for example by pressure forming. Such a process allows the funnel to be formed on the supply line as an integrally formed attachment with a widening from the outside to the inside or vice versa.

The shape of the funnel may be formed in the casting mold, particularly if the supply line or the entire main oil gallery is produced in a casting process.

Advantages, features and details of the inventive solution in the case of a supply line of a main oil gallery for the crankcase of an internal combustion engine will emerge from the following description of exemplary embodiments and with reference to the schematic illustrations therefor in the drawing. The described features and combinations of features, as shown hereinbelow in the figures of the drawing, and the features and combinations of features described with reference to the drawing are applicable not only in the combination indicated in each case, but also in other combinations or else in isolation without thereby departing from the scope of the invention.

DETAILED DESCRIPTION

Figure 1:
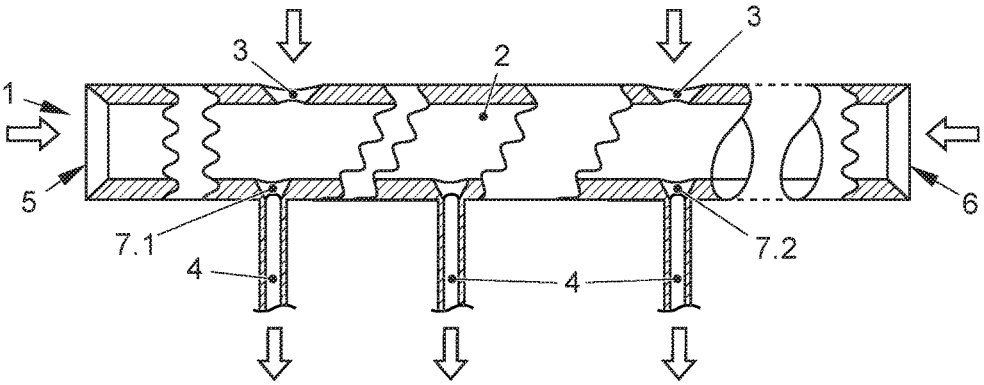
FIG. 1 shows a main oil gallery according to the invention for feeding lubricating or cooling oil to bearing points of a crankshaft of an internal combustion engine via a substantially tubular supply line having an inflow opening formed in a flow-concentrating manner.

The tubular supply line 2 of the main oil gallery 1 is provided with at least one inflow opening 3 for the oil and with a number of feed lines 4 for the oil that corresponds to the number of bearing points to be supplied. The feed lines 4 are provided with feed line openings 7.1 and 7.2 formed in a flow-favorable manner for targeted feeding of the oil to the bearing points to be lubricated. In addition, oil can be channeled to the feed lines 4 via the open ends 5 and 6 and the tube interior of the supply line.

The flow channeling of the oil is indicated by arrows in the figures.

The inflow opening 3 channels the oil into the tube interior of the supply line 2 and from there, via the feed line openings 7.1 and 7.2 into the feed lines 4, in a targeted manner to the bearing points to be supplied with oil. The inflow opening 3 or 5 and 6 for the oil flow in the crankcase are formed in a flow-favorable manner. More particularly, the walls of the inflow opening 3 are beveled or chamfered all the way around and are arranged in a narrowing configuration to pass the flow in a concentrating manner toward the center of the tubular supply line 2. Such a formation of the inflow opening 3 is particularly expedient when the oil distribution in the crankcase in the main flow is distributed substantially in a direction perpendicular to the axis of the supply line 2.

Figure 2:
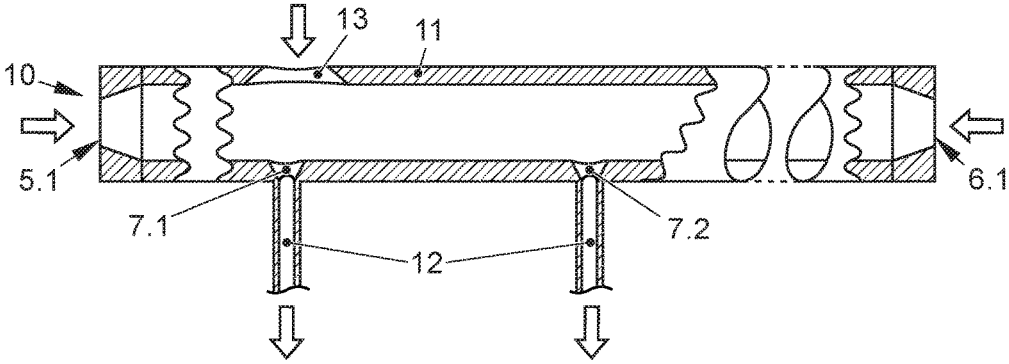
FIG. 2 shows a main oil gallery according to the invention for feeding lubricating or cooling oil to bearing points of a crankshaft of an internal combustion engine via a substantially tubular supply line having an inflow opening formed in a flow-dissipating manner.

By contrast, FIG. 2 shows a main oil gallery 10 having a supply line 11, which is again of tubular design, and feed lines 12 with feed line openings 7.1 and 7.2 formed in a flow-favorable manner to achieve a targeted feeding of the oil to the bearing points for the crankshaft in the crankcase. In this example, the inflow opening 13 (or 5.1 and 6.1) is provided, in a flow-dissipating manner, with a widening arranged obliquely inward toward the center of the tubular supply line 11. Such a formation of the inflow opening is expedient when the oil in the crankcase propagates mainly in an approximately parallel direction to the supply line. Correspondingly, the open ends 5.1 and 6.1 of the supply line 11 can be formed so as to widen toward the tube interior in a flow-dissipating manner. To simplify the production in the case of machining, these ends can be formed as inserts or attachments.

The supply lines 2 and 11 according to FIGS. 1 and 2 can be produced in a simple manner together with the entire main oil gallery 1, 10 in a casting process or else be built up from metal tubes or from tubes composed of heat-resistant and oil-resistant plastic and inserted into the crankcase. The inflow openings 3 and 13 and the open ends of the supply lines 2 and 11 can be machined using simple tools. The inflow opening 3 can be produced, for example, by beveling by means of a countersinking tool, whereas the inwardly widening inflow feed line opening 13 can be produced, for example, by means of milling.

The design of the flow-promoting inflow openings 3 and 13 in the supply line 2 and 11 can be formed to extend to a greater or lesser extent in terms of its funnel-shaped profile depending on the flow conditions in the crankcase. The casting process and/or the pressure forming process may be carried out so that the funnel shape is individually selectable with side walls of the inflow openings being inclined or bent out to different degrees and also with a height of the funnel that can be chosen to be different, or else, alternatively, in other flow-favorable geometries.

LIST OF REFERENCE SIGNS

1 Main oil gallery
2 Supply line
3 Inflow opening
4 Feed lines
5 Open end of 2
5.1 Open end of 11
6 Open end of 2
6.1 Open end of 11
7.1 Feed line opening
7.2 Feed line opening
10 Main oil gallery
11 Supply line
12 Feed line
13 Inflow opening

What is claimed is:

1. A main oil gallery for distributing lubricating or cooling oil to bearing points of a crankshaft of an internal combustion engine, comprising:

a substantially tubular supply line extending in an extending direction between open ends, the supply line having a wall with opposed inner and outer surfaces extending in the extending direction, at least one inflow opening penetrating through the wall, and at least one feedline opening penetrating through the wall at a position spaced from the inflow opening, the at least one feedline opening having an outer cross-sectional area at the outer surface of the supply line and an inner cross-sectional area at the inner surface of the supply line, the outer cross-sectional area being different from the inner cross-sectional area; and at least one feedline for feeding the lubricating or cooling oil to the bearing points of the crankshaft in the crankcase coupled to the at least one feedline opening.

2. The main oil gallery of claim 1, wherein the inflow opening is formed with a flow-concentrating shape.

3. The main oil gallery of claim 1, wherein the inflow opening is formed with a flow-dissipating shape.

4. The main oil gallery of claim 1, wherein the inflow opening is substantially funnel-shaped.

5. The main oil gallery of claim 4, wherein the funnel-shaped inflow opening narrows from the outer surface of the wall of the supply line to the inner surface of the wall of the supply line.

6. The main oil gallery of claim 4, wherein the funnel-shaped inflow opening widens from the outer surface of the wall of the supply line to the inner surface of the wall of the supply line.

7. The main oil gallery of claim 4, wherein the funnel shape of the inflow opening is produced by machining.

8. The main oil gallery of claim 4, wherein the funnel shape of the inflow opening is produced by pressure forming.

9. The main oil gallery of claim 4, wherein the supply line is made of metal material.

10. The main oil gallery of claim 4, wherein the supply line is a cast supply line.

11. The main oil gallery of claim 4, wherein the supply line is made of plastic.

* * * * *